US005694744A

United States Patent [19]

Jones

[11] Patent Number: 5,694,744

[45] Date of Patent: Dec. 9, 1997

[54] ARTICLE PACKAGING KIT, AND METHOD

[76] Inventor: William Charles Jones, 3 Ida La., East Sandwich, Mass. 02537

[21] Appl. No.: 608,729

[22] Filed: Feb. 29, 1996

[51] Int. Cl.[6] ..... B65D 75/00

[52] U.S. Cl. ..... 53/449; 53/456; 206/223; 206/495; 206/591

[58] Field of Search ..... 206/223, 305, 206/320, 426, 446, 461, 466, 495, 497, 521, 524.9, 583, 591, 594, 775, 776, 778, 779, 477–483; 53/449, 456, 441

[56] References Cited

U.S. PATENT DOCUMENTS

| | | |
|---|---|---|
| 2,707,553 | 5/1955 | Yount . |
| 2,802,565 | 8/1957 | Kabbash . |
| 2,919,797 | 1/1960 | McCracken . |
| 3,089,590 | 5/1963 | Mell . |
| 3,424,306 | 1/1969 | Munck . |
| 3,507,383 | 4/1970 | Rorer . |
| 3,540,579 | 11/1970 | Hellstrom . |
| 3,669,337 | 6/1972 | Struble . |
| 3,718,275 | 2/1973 | Willinger . |
| 3,891,090 | 6/1975 | Spiegel et al. . |
| 3,905,474 | 9/1975 | Haibara . |
| 4,030,603 | 6/1977 | Angell . |
| 4,285,432 | 8/1981 | deVillers et al. . |
| 4,494,689 | 1/1985 | Ilitch . |
| 5,086,925 | 2/1992 | Coalier et al. . |
| 5,323,896 | 6/1994 | Jones ..... 206/223 |
| 5,388,701 | 2/1995 | Ridgeway . |

FOREIGN PATENT DOCUMENTS

| | | |
|---|---|---|
| 691904 | 8/1964 | Canada . |
| 49-59982 | 5/1974 | Japan . |
| 49-77087 | 7/1974 | Japan . |
| 50-88376 | 7/1975 | Japan . |
| 50-102778 | 8/1975 | Japan . |
| 50-107583 | 9/1975 | Japan . |
| 57-177969 | 11/1982 | Japan . |
| 3-100158 | 10/1991 | Japan . |

*Primary Examiner*—Jimmy G. Foster
*Attorney, Agent, or Firm*—Richard P. Crowley

[57] ABSTRACT

A packaging kit for the immobilization of an article to be packaged, which kit comprises a stiff sheet of material of defined width and length, sufficient to hold the article being packaged, having a base portion, the sheet material characterized by at least one fold line, extending substantially across the base portion, which permits the base portion to be folded inwardly, to receive an article to be packaged on the base portion thereof. The sheet material has a pair of spaced apart, opposite, end portions with outside edges, and with the end portions adapted to move the fold lines between a generally flat position and a folded position to immobilize an article on the base portion. A film material of selected dimensions and length, is used to cover at least a substantial portion of the article to be immobilized on the base portion, and having a one and the other end. A tension-biased clip is used to clip the one or the other or both ends of film material to the one or the other or both outside edges of the end portions of the stiff sheet material, over and above the article in a generally flat position, whereby on folding the base portion an article may be inserted underneath the film material, after clipping the film material in place at the one or both ends to the base portion, the opposite spaced end portions of the stiff sheet material may be folded so as to tighten the film material about the article and to immobilize the article on the base portion.

31 Claims, 2 Drawing Sheets

ARTICLE PACKAGING KIT, AND METHOD

DESCRIPTION

BACKGROUND OF THE INVENTION

There are a wide variety of packaging kits, systems and methods for the immobilization of articles in packaging, particularly fragile or odd-shaped articles, and for arranging the packaged articles in an outside container for shipment.

One article packaging kit, system and method is described in U.S. Pat. No. 5,323,896, issued Jun. 28, 1994, hereby incorporated by reference in its entirety. This patent describes a unique packaging kit for the immobilization of an article to be packaged, such as to be placed within another container. The kit comprises a relatively stiff sheet material, such as a corrugated cardboard of defined width and length, having a base portion to hold the article. The end portions on opposite sides of the base portion have a fold line to define and permit the end portions to move between a generally non-use flat position and a folded position. The base also includes another fold line, perpendicular to the end fold lines and generally centrally positioned to permit the base portion to be folded. The kit includes a means, including a film tube comprised of a plastic sheet material, dimensioned and adapted to be placed about the stiff sheet material base portion, and generally will fit around the base. The kit provides, after the article is inserted on the base portion or in between the base portion and the film sheet material, for the film material to immobilize the packaged article by hugging the article on the base portion, such as clinging by a tension-clinging relationship to the article. This article packaging kit, system and method is simple, easy, effective, safe and the components are easily recyclable to provide for an improved packaging kit, system and method.

U.S. Pat. No. 3,905,474, issued Sep. 16, 1975, also relates to a packing device which is comprised of a base sheet material having a fold line, but employs a plastic film composed of an overlying relationship on the base sheet; however, the opposite ends of the plastic film are secured to the base sheet. Bending the sheet at the fold line forms a space between the secured end of the film, wherein the article is inserted, and then the sheet is bent in fold lines in an opposite direction, to draw the plastic film taut over the bent sheet, to immobilize the object. This patent, with a specific length of plastic film, with both ends fixed to the base portion of a sheet material, is not wholly satisfactory, in that it limits the dimensions of the article to be immobilized, and also does not make the components of the packaging kit wholly recyclable, without additional effort to remove the film material from the base sheet.

It is therefore desired to provide for a new, easy effective and also recyclable improved packaging kit, system and method, which avoids the limitations of the prior systems, and provides for the immobilization, particularly of odd-shaped articles, or articles of varying height, sizes and shapes, while placing the immobilized articles within an outer container for shipment.

SUMMARY OF THE INVENTION

The invention relates to a packaging kit, system and method for the immobilizing of an article, particularly for use when placing the immobilized article in an outer container.

The invention relates to a packaging kit, system and method, wherein the packaging kit is designed for the immobilization of an article, usually to be packaged in a separate container, and which kit comprises a stiff sheet material, like a corrugated or cardboard type material of defined width and length, sufficient to hold the articles to be packaged, and having a base portion, and with the sheet material characterized by at least one fold line across the sheet material base portion, to permit the base portion to be folded inwardly in a manner such as to receive an article to be packaged on the base portion, and also having spaced apart end portions with outside edges and fold lines on the base portion between the base portion and the end portions, with the end portions adapted to move between a generally flat position and a folded position, such as a folded up or folded down position, to immobilize a packaged article on the base portion.

The packaging kit of the invention also includes a film material of selected dimensions, which may be a tension-clinging, transparent or nontransparent, foam or non-foam thin sheet material employed for packaging and having a length, for example of about the length of the base portion together with the end portion, or a much longer length, and of a sufficient width to place about and to cover the articles to be immobilized when the article is placed on the base portion. The film material is typically a tension-clinging film material, and generally a thermoplastic thin film material, that may be cut or dimensioned to a selected length, and in fact, in one embodiment, may be the general length of the end portions, or may be wrapped around the immobilized articles many times before being used to immobilize the article as hereinafter set forth.

The packaging kit also includes a tensional type clip-retaining means, clipping and retaining at least one, and usually the other, or both, edges of the end portions, and the one end or usually the other, or both ends of the film material, to the edge portions of the sheet material in a secure manner.

In operation, the packaging kit provides for creasing the fold line, typically a center fold line on the base portion, which base portion may have other fold lines, and inserting the article to be inserted onto the base portion. The kit also provides for placing the film material over the base portion and clipping the film material in position, to the base portion either before or after inserting the article in the base portion, and thereafter, when the film material is secured in position, generally in a somewhat loose position, folding the end portions so as to stretch the film material and place the film material, for example, in a taut, immobilization position, about and to cling to the article on the base portion, such as for example, folding the end portions downwardly to increase the tension on the film material. The kit also permits folding the end portions downwardly, for example, the end portions to serve as a spacer in an outside container, or, as desired, the end portions can be completely folded down and under and rendered parallel to the underside of the base portion.

The packaging kit, system and method of the invention is advantageous in that it can be composed of few in number and of simple components, and is easily employed and assembled to immobilize an article. In particular, the components are all recyclable, that is, the sheet material, which may be a stiff cardboard, and the film may be reused, and in addition the two clip means may be reused. Further and importantly, the packaging kit permits the immobilization of articles of varying height, or a plurality of articles, since the length of the film may vary depending upon the height of the article to be immobilized. Also of importance is that the film material may be wrapped not once, but several times about the article to be immobilized, either totally about the base portion of the sheet material, or folded back and forth from one to the other end of the end portions, prior to being clipped and retained in place, and prior to the end portions being folded down, to immobilize the article, with such additional film as required for further immobilization.

Another advantage of the packaging kit is that the end portions may be folded downwardly, at about a 90° angle, prior to insertion in a shipping container or box, and thus position the immobilized article on the base portion above the bottom level of the box, and with the bottom level of the box, if desirable, containing insulating or cushioning materials, such as loose fill or foam, or even another item to be shipped. Of course, it is recognized that loose film, foam paper and other packaging and insulating material to prevent damage to the immobilized article may be secured not only below the base portion, but about all sides of the fully immobilized article after being placed in the box and the box sealed for packaging and shipping.

The sheet material is useful in the kit, system and method may comprise any type of relatively stiff or hard supportable sheet-type material, and particularly adapted for use with paper or corrugated cardboard type material, where one or more horizontal and two or more vertical fold lines may be easily imparted to the sheet material, for example, by a prescoring technique to permit easy folding of the sheet material. The sheet material may vary in dimensions, but typically has an elongated rectangular or square shape, and generally with each of the end portions, in one embodiment, connected to the base portion, the base portion with fold lines and spaced apart therefrom, while in another embodiment the sheet material may contain four end portions, that is, opposing end portions on either side of the base portion, each with fold lines. In the latter instance, two of the end portions may, for example, be folded down when the immobilized article is placed in the container, while two of the remaining opposing end portions may be also folded down or folded up to provide for additional protection. The sheet material does require at least one fold line, so that the sheet material in the base portion may be creased in order to insert the article to be immobilized, which generally includes two or more spaced apart parallel fold lines to identify the end portion, or where there are four end portions, the two pairs of spaced apart fold lines are separated by 90°, as will be more particularly illustrated in the illustrated embodiments of the invention.

The film sheet material employed with the stiff sheet material to form the kit can be selected from a wide variety of materials, but generally comprises paper, foam or other materials in sleeve or tube form, or length-type form, say, for example, from a roll and which may be employed and preferably is slightly stretchable or article-formed hugging in use, so that it may hug and immobilize an article on the base portion of the sheet material when subject to tension of the folding of one or more of the opposite end portions. Such film material includes, but is not limited to, a slightly structural, tear-resistant plastic heat oriented film-type material, for example, olefinic vinyl and vinyl-type films, more particularly a polyethylene. The film thickness, of course, may vary as desired, and generally ranges from 1–20, or, for example, from 1–2 to 10 mils. Typically, the film material may be of a transparent plastic material, so that the immobilized article may be visually observed during immobilization, and particularly where the immobilized article is displayed for resale purpose in the immobilized condition. The film material, may, of course, comprise a foam type or air bubble type of film material.

The film material is cut to a desired length that extends and fits over a sufficient portion of the article, and over the base portion to immobilize the article, and generally extends in width at least the width of the article, although several layers may be used if the width is not enough, or in length, generally over and about the entire length of the article. Where desired, the film material may be doubled up to extend beyond the length of the base portion of the sheet material. In any event, the film material extends at least over the one end or over both the end portions.

In one preferred embodiment, the sheet material is merely taken from a roll and cut to the desired size, depending on the height of the article to be immobilized, with the ends of the article secured by the clip-type means, to either opposite end of the end portions of the stiff sheet material. This allows selection of the sheet material, as desired, from a roll of material, without wasting material, and yet permits the material after use to be recycled. The film material may, for example, be folded over to this length, or several sheets of the material may be used, one over the other, of the same or different type material in order to cover the article. Further, the film material width may be greater than the width of the base portion as desired to more fully enclose the article.

Another and important component of the packaging kit of the invention comprises the employment of conventional-type clip means, so that one, the other, or both ends of the film sheet material may be clipped to the outer edge of the opposite end portions of the stiff sheet material. For example in one embodiment, the sheet material may be clipped at each end, therefore to secure the article to be immobilized on the base portion, and then a film material placed over the article in a perpendicular direction, and secured to the end portion of the edges of the adjacent end portions, so that a cross film extends over the article to more completely secure the article in position. In another embodiment, one end of the film material may be adhesively secured, just generally adjacent and for example along the edge portion or one edge of the end portions, such as by using adhesive material or by thermoforming one end of the edge portion, and then using the clip only to make the film material taut over the article and then securing the clip to only one end of the edge portion.

However, in one preferred and illustrated embodiment, it is desirable to have the packaging kit composed of only three components, that is a stiff sheet material forming the base portion with the end flap portions, a plastic film sheet material, and a pair of biased and inexpensive clips to retain each end of the sheet material to the outer edge of the end portions.

A wide variety of tension-biased clip means can be employed in order to secure the film sheet to the end portions of the stiff sheet material, such as, for example, but not limited to, spring-biased metal clips. However and preferably, for simplicity and cost, the preferred clip means comprise simple and inexpensive plastic molded c-type clips, which may be easily forced open to the thickness of the edge portion of the stiff sheet material and the film by hand pressure of the user, and then be biased inwardly grasp securely the film material and the sheet material on the biased edge of the clip. The clips may vary in length, and in tension, but typically a clip should extend generally at least a major portion, and usually substantially the length of the edge portion of the opposite spaced end portions of the stiff sheet material, to provide a secure means to hold the film material in position.

The kit optionally would include an outer container or box, in which the immobilized article on the stiff sheet material may be inserted and then contained, sealed, packaged and shipped, along with optionally other packaging material or articles to be shipped.

In operation, a stiff sheet material is placed on a flat surface. The film material is secured at one end by a plastic clip to the edge portion or one end portion, the base portion bent slightly inwardly generally along a central fold line, and the article to be immobilized is placed therein, and then the film material is drawn over the article and the opposite end, then secured with the other clip to the opposite edge of the other end portion, to place the film material in a loose, but not too loose, and taut, but not too taut, condition over the article to be immobilized, and then the sheet material placed in a generally flat condition. The article is then fully immobilized against the tension-clinging film, and secured at each end with a pair of clip means by bending the end portions downwardly as desired, typically for example, 90°, so that the secured film material is then drawn tightly over the top surface of the article.

Where additional end portions are in the stiff sheet material, the end portions then may be folded upwardly or downwardly, and then the entire assembly inserted in a container box for shipment. The clip means are used to secure one end of the film material to the stiff sheet material, and then with the base in a flat position and the article to be packaged on the base, the film is pulled taut and the second clip is used to secure the film, or the film secured in one end adhesively and then only one clip employed. The two end portions are then folded downwardly to immobilize the article and to provide additional protection to the additional open sides of the article being immobilized. The additional end portions on opposite sides may then be folded upward, thus providing complete protection for the immobilized article.

The invention will be described for the purposes of illustration only in connection with certain preferred embodiments; however, it is recognized that those persons skilled in the art may make various modifications, changes, improvements and additions to the illustrated embodiments shown, all without departing from the spirit and scope of the invention.

BRIEF DESCRIPTION OF THE DRAWINGS

FIG. 4 is a perspective, exploded illustrative view showing the immobilized article of the invention on the stiff sheet material, ready for insertion in the packaging container.

FIG. 5 is a perspective exploded illustrative view showing the immobilized article of the invention with the packaging kit of the invention folded in a display position.

DESCRIPTION OF THE EMBODIMENTS

Figure 1:
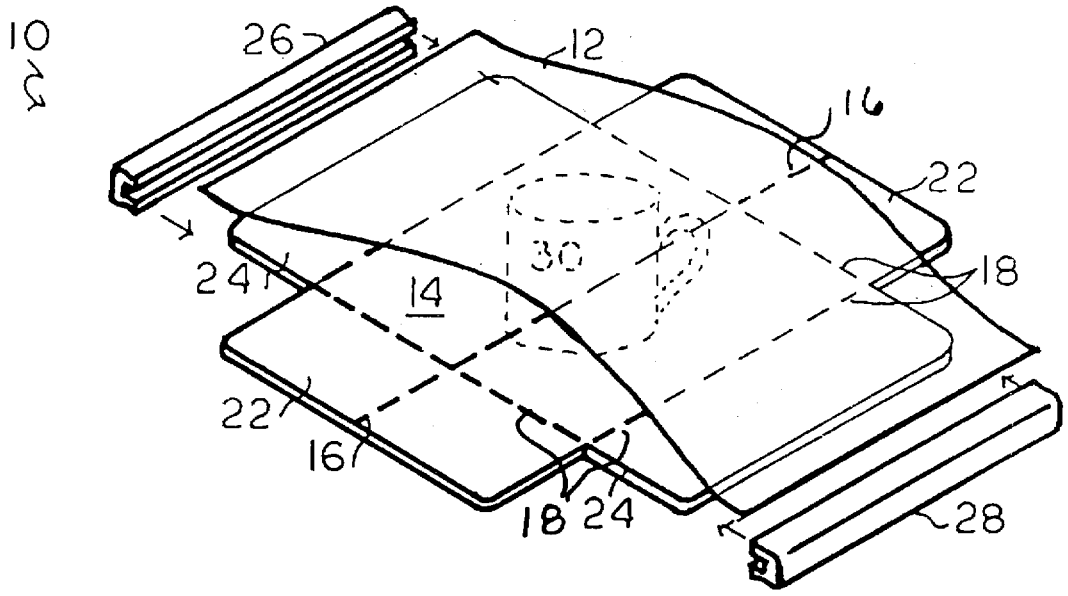
FIG. 1 is partially exploded perspective view from above of the components of the packaging kit of the invention prior to assembly.

In the drawings, FIG. 1 shows the article packaging kit of the invention 10 with plastic film material 12 extended over a corrugated paper cardboard base portion 14. Base portion 14 is formed with connecting front and back end portions 22 and two side end portions 24. The end portions extend from base portion 14, and fold lines 18 are molded into the base portion at the point of end portion attachment. A center fold line 16 extends down the middle of base portion 14 and also bisects front and back end portions 22. Fastener clips 26 and 28 are shown in position to fasten the plastic film material 12 to the outer edges of the side end portions 24. An article to be packaged 30 is shown, in broken line, positioned centrally on the base portion 14.

Figure 2:
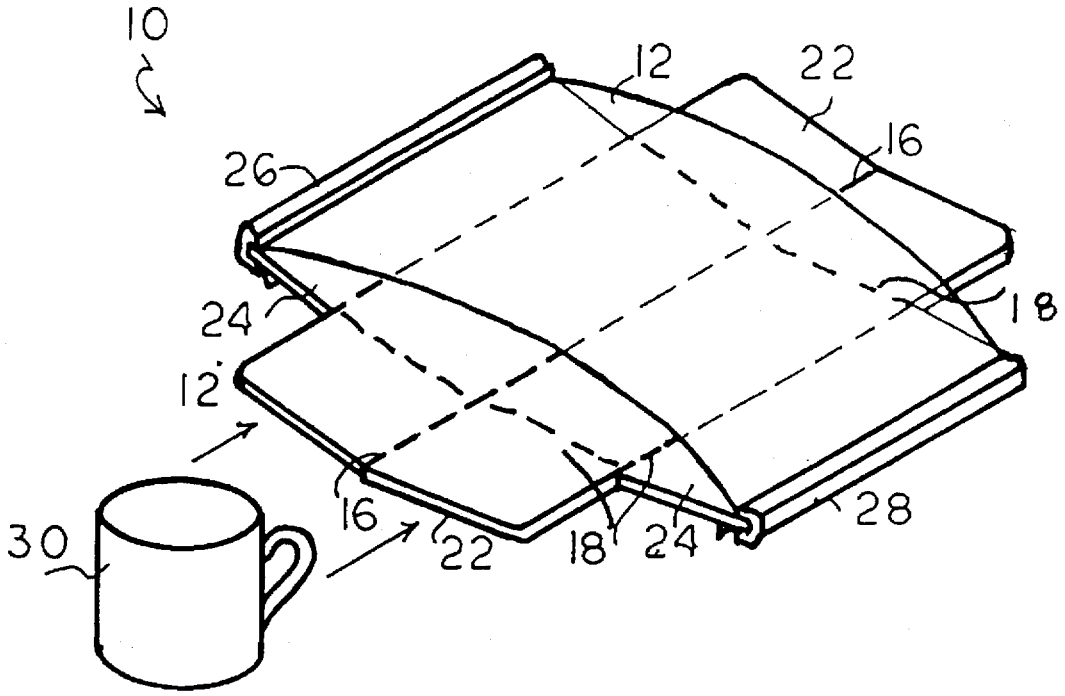
FIG. 2 is a perspective view of the article to be inserted into the invention of FIG. 1, with the ends of the film material clipped in position.

FIG. 2 shows the article packaging kit of the invention 10 in an assembled, ready to use configuration. The plastic sheet material 12 is extended over the two side end portions 24 and fastened to the ends of the end portions 24 with clip fasteners 26 and 28 respectively. The base portion 14 is folded slightly along the center fold line 16 to provide a space for the article 30 to be inserted between the plastic sheet material 12 and base portion 14.

Figure 3:
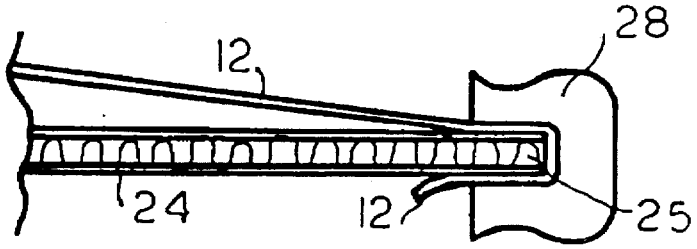
FIG. 3 is an enlarged, cutaway sectional view of the clip fastener of the invention.

FIG. 3 illustrates in an enlarged, cutaway sectional view the plastic sheet material 12 extended around the outer edge 25 of the side end portion 24 and fastened thereto by clip fastener 28.

FIG. 4 shows the article packaging kit of the invention 10 in a folded, use position with the article 30 inserted between the base 14 and the plastic sheet material 12. The plastic sheet material 12 is extended over the article and around the side end portions 24 of the base portion 14, where the material 12 is fastened in place by the clip fasteners 26 and 28 respectively. The side end portions 24 are then folded down to stretch and immobilize the article 30 within the material 12, and the front and back end portions 22 are folded up to prevent any folding or buckling of the base portion 14 at the center fold line 16. The immobilized article 30, within the packaging kit 10, is then ready to be inserted into a container 32 for shipping or storage.

FIG. 5 shows in perspective view another configuration of the article packaging kit of the invention 10. In this drawing, all of the end portions 22 and 24 are folded down to create a display stand for the article 30. The plastic film material 12 is transparent to allow for visibility of the article 30.

In operation, the article packaging kit of the invention 10 comes available in a kit form, with a base portion 14, a length of plastic sheet material 12, two clip fasteners 26 and 28, and optionally and preferably a shipping container 32. To package an article 30, the user simply places the base portion 14 on a flat, hard surface, and extends one outer edge of the sheet material 12 over the outer end 25 of the side end portions 24, and fastens the sheet material 12 to the end portion with a clip fastener 26 or 28. The article 30 is then placed in the middle of the base portion 14, and the other end of the plastic sheet material 12 is extended over the article 30 and the opposite side end portion 24, and fastened with clip fastener 28. The center fold line 16 provides for slight flexibility of the base portion if needed while fastening the clips or while inserting the article 30. After both clips have been fastened, the side end portions 24 are then folded down to stretch the plastic sheet material 12 and immobilize the article 30. Finally, the front and back end portions 22 are folded either up, for packaging, or down, for display purposes, to stretch sheet material 12 taut and to prevent the buckling of the center fold line 16, to provide for the complete immobilization of the article 30.

Thus, the article packaging kit system and method of the invention provides for an easy to use, lightweight, flexible and versatile packaging kit, that can contain and immobilize a variety of articles, including one or a plurality of articles of the same or different shapes, sizes and compositions. The kit itself may be produced in a variety of shapes and sizes as desired by the manufacturer for the desired intended use. Further, the unassembled kit is easy to transport and store, and each part is reusable and recyclable either together or for separate uses.

What is claimed is:

1. A packaging kit for the immobilization of an article to be packaged, which kit comprises:

a) stiff sheet of material of defined width and length sufficient to hold the article being packaged, having a base portion, said sheet material characterized by at least one fold line, extending substantially across said base portion and which permits said base portion to be folded inwardly, to receive an article to be packaged on said base portion thereof, and said sheet material having a pair of spaced apart, opposite, end portions with outside edges, and having end fold lines generally parallel to said one fold line and adapted to move said end portions between a generally flat position and a folded position to immobilize an article on said base portion;

b) a film material of selected dimensions and length adapted to be used to cover at least a substantial portion of the article to be immobilized on said base portion, and having a first and second end; and c) a clip means to clip said first or said second or both ends of said film material to one or the other or both of said outside edges of said end portions of said stiff sheet material, over and above the article in a generally flat position, whereby on folding said base portion along said fold line extending substantially across said base portion an article may be inserted underneath said film material, after clipping said film material in place at said first or said second or both ends to said base portion, said opposite spaced end portions of said stiff sheet material are folded, so as to tighten said film material about the article and to immobilize the article on said base portion.

2. The kit of claim 1 wherein said clip means comprises two biased clips to clip said film material at said first and said second end respectively to said one and said other outside edges of said end portion of said stiff sheet material.

3. The kit of claim 1 wherein said one fold line is a generally centrally positioned fold line extending substantially across said base and said end portions of said stiff sheet material.

4. The kit of claim 1 wherein said clip-means is a one-piece, biased molded, plastic clip that is removable and reusable.

5. The kit of claim 3 wherein said stiff sheet material includes an additional pair of opposite, spaced apart end portions about said base portion, said additional end portions each having a fold line generally perpendicular to said one fold line, enabling each additional end portion to be folded from a flat position upwardly or downwardly.

6. The kit of claim 1 wherein said sheet material comprises a corrugated cardboard sheet material.

7. The kit of claim 1 wherein said film material comprises an elongated length of film material having a width substantially the width of said base portion, and having a length equal to or substantially greater than the length between said edge portions of the respective oppositely spaced apart end portions.

8. The kit of claim 1 wherein said film material has both ends free and wherein the free ends are adapted to be clipped to the one and other outside edges respectively of the end portions.

9. The kit of claim 1 wherein said film material comprises a flexible, stretchable plastic film material.

10. The kit of claim 1 wherein said film material comprises a plastic, clinging transparent film material, the material selected from the group consisting of an olefinic polymer, a vinyl halide resin and a urethane polymer.

11. The kit of claim 1 wherein said first end of said film material is adhesively secured adjacent to, about and generally along the length of one edge of said end portion, and said second end is free and said clip means provides for clipping said second free end of said film material to the opposite edge from the one edge of said end portion.

12. The kit of claim 1 wherein said clip means comprises a pair of molded plastic, biased clips having an elongated slot therein, is biased inwardly and substantially the length of the width portion of said end portions, to secure said film material in position.

13. The kit of claim 1 wherein said end portions are turned downwardly at least 90° from the plane of said base portion of said stiff sheet material.

14. The kit of claim 1 wherein said end portions are turned downwardly and completely under the base portion of the sheet material to be in a parallel configuration with the base portion.

15. The kit of claim 1 which includes a container for the insertion of the immobilized article and said sheet material into said container.

16. The kit of claim 15 wherein said end portions are folded downwardly approximately 90° to provide support within said container to space said immobilized article from the bottom of said container.

17. The kit of claim 1 wherein each of the end portions have the width of the base portion end and the end portions have an equal length.

18. The kit of claim 1 wherein said one fold line extends across the base portion and across the opposite end portions to the outside edges.

19. A packaging kit for the immobilization of an article to be packaged, which kit comprises:

a) a stiff sheet of material comprised of a corrugated cardboard sheet material of defined width and length sufficient to hold the article being packaged and having a base portion, said base portion characterized by at least one fold line which permits said base portion to be folded inwardly, to receive an article to be packaged on said base portion thereof, and said sheet material comprises two pairs of opposite, spaced apart end portions about said base portion, said end portions with outside edges, and one pair having end fold lines generally parallel to said one fold line and adapted to move said one pair of end portions between a generally flat position and a folded position, and another pair having end fold lines generally perpendicular to said one fold line and adapted to move said other pair of end portions from a flat position upwardly or downwardly;

b) a film material of selected dimensions and length, adapted to be used to cover at least a substantial portion of said article to be immobilized on said base portion, and having a first free end and a second free end, wherein said film material comprises a flexible, stretchable, plastic, clinging transparent film material; and c) a tension-biased clip means, wherein said clip means comprises a pair of molded plastic, biased clips having an elongated slot therein, biased inwardly and substantially the width of said one end portion, to secure temporarily said first or said second or both free ends of said film material to said one or said other or both outside edges of said one end portion and over and above said article with the base portion in a generally flat position, and whereby on folding said base portion along said one fold line an article may be inserted underneath said film material, the opposite spaced one end portion adapted to be folded, so as to tighten said film material about the article and to immobilize the article on said base portion to place said film material in a taut, clinging position, and wherein the two opposite other end portions adapted to be folded downwardly to support the base portion or upwardly to protect the immobilized article.

20. The kit of claim 19 which includes a container for the insertion of the immobilized article and said sheet material into said container, and wherein said one and other pairs of end portions are downwardly folded to space said immobilized article on the base portion from the bottom of the container.

21. The kit of claim 19 which includes a container for the insertion of the immobilized article and said sheet material into said container, and wherein the one pair of end portions are folded downwardly to space said immobilized articles and the base portion from the bottom of the container, and the other pair of end portions are folded upwardly on either side of said immobilized article.

22. A method for the immobilization of an article within an outer container or for display, which method comprises:

a) providing a stiff sheet of material, said material of defined width and length sufficient to hold the article to be immobilized, having a base portion thereof, characterized by at least one fold line extending across said base portion, to permit said base portion to be folded inwardly, and having opposite spaced apart end portions with outside edges and with end fold lines generally parallel to said one fold line, so that said end portions may move between a generally flat position and a folded position;

b) placing the article to be immobilized on said base portion of said sheet material;

c) selecting a tension-clinging film material of selected dimensions, length and width and having fold ends to immobilize the article;

d) securing one free end of said film material adjacent an outside edge of one of said end portions;

e) extending said film material over said sheet material with said article on said base portion in a generally flat position to a generally snug fitting condition;

f) securing said other free end of said film material employing a clip means to retain said film material to the outside edge of the other opposite end portion of said base material; and g) moving said end portions downwardly to secure said film material in a tight, tension-clinging position about the article to be immobilized on said base portion, thereby providing an immobilized article on said base material.

23. The method of claim 22 wherein said sheet material comprises a relatively stiff, corrugated cardboard sheet material wherein said one fold line is a generally centrally positioned fold line and extending along said length of said base portion, and generally parallel to two fold lines, which define the opposite spaced apart end portions, and folding said sheet material into an article-inserting position along said one central fold line, so that the article may be inserted beneath said film material.

24. The method of claim 22 which includes moving said end portions approximately at least 90° downwardly to immobilize the article in said base portion.

25. The method of claim 22 which includes placing the immobilized article with said end portions downwardly into a container box of similar dimensions to retain the immobilized article for shipment.

26. The method of claim 22 wherein said sheet material includes two additional adjacent end portions, with fold lines, said fold lines generally perpendicular to said fold lines of said base portion, and moving said additional end portions between a generally flat position and a downward or upward position, thereby providing for additional support within a container when said additional end portions are moved downwardly along with the adjacent end portions, or moving said additional end portions upwardly to provide for additional protection of the immobilized article within a container.

27. The method of claim 22 wherein said film material includes a transparent, stretchable, clingable, flexible flat plastic film material which includes a pair of reusable tension-biased molded plastic clip means, and which method includes clipping said clip means at either free end of said film material to secure said film material about the article to be immobilized.

28. The immobilizing article prepared by the method of claim 22.

29. A method for the immobilization of an article for packaging within an outer container or for display, which method comprises:

a) providing a stiff sheet of material, said material of defined width and length sufficient to hold the article to be immobilized, having a base portion thereof, characterized by a generally central fold line extending across said base portion, to permit said base portion to be folded inwardly, and having opposite spaced apart generally equal length end portions extending from said base portion, said end portions having outside edges and fold lines, so that said end portions may move between a generally flat position and a folded position;

b) placing the article to be immobilized on said center fold line of said base portion of said sheet material;

c) selecting a tension-clinging film material of selected dimensions, length and width and having free ends to immobilize the article, of sufficient size to extend over said base portion, the article and said two end portions;

d) securing one end of said film material to one outside edge of one end portion with a tension-biased plastic clip;

e) extending said film material over said sheet material with the article on said base portion in a generally flat position, to a generally snug fitting condition at said one end;

f) securing the other end of said film material to the outside edge of the opposite end portion employing a tension-biased plastic clip to said outside edge portion of said end portion of said base material; and g) moving one or both end portions to secure said film material in a tight, tension-clinging position about the article to be immobilized on said base portion, thereby providing an immobilized article on said base portions.

30. The method of claim 29 which includes:

a) providing a container having a bottom for the immobilized article on the base portion; and b) inserting the base portion with the immobilized article thereon into the container with the two end portions folded generally perpendicularly downwardly to support and space the base portion from the bottom of the container.

31. The article-immobilized container produced by the method of claim 30.

* * * * *